US005896599A

United States Patent [19]

Bosio

[11] Patent Number: 5,896,599

[45] Date of Patent: Apr. 27, 1999

[54] SLIDING SUPPORT FOR SHOWER HEAD

[75] Inventor: Gianni Bosio, Castelgoffredo, Italy

[73] Assignee: Chimasi S.r.l., Mantova, Italy

[21] Appl. No.: 08/840,918

[22] Filed: Apr. 25, 1997

[30] Foreign Application Priority Data

May 2, 1996 [IT] Italy ..... MN96U0007

[51] Int. Cl.[6] ..... A47K 3/22

[52] U.S. Cl. ..... 4/605; 4/567; 4/615; 4/570; 4/697; 285/322

[58] Field of Search ..... 4/567, 568, 570, 4/597, 605, 615; 248/316.7, 309.1; 403/109, 377; 285/322, 323; 24/483

[56] References Cited

U.S. PATENT DOCUMENTS 2,890,900 6/1959 Williamson, Jr. et al. ..... 285/322

5,277,391 1/1994 Haug et al. ..... 4/605

FOREIGN PATENT DOCUMENTS 594 075 4/1994 European Pat. Off. .

1 356 351 6/1964 France .

1356351 6/1964 France ..... 4/615

8 504 974 5/1989 Germany .

9 110 622 10/1991 Germany .

4040668 7/1992 Germany ..... 4/615

*Primary Examiner*—David J. Walczak

*Assistant Examiner*—Tuan N. Nguyen

*Attorney, Agent, or Firm*—Guido Modiano; Albert Josif

[57] ABSTRACT

A sliding support for shower head, including a slider associated with a guide which is fixed to a wall and has, at least at one end, tabs provided with at least an element adapted to clamp the tabs in contact with the guide, an end element being associated with the slider and being provided with elements for coupling the shower head.

7 Claims, 2 Drawing Sheets

SLIDING SUPPORT FOR SHOWER HEAD

BACKGROUND OF THE INVENTION

The present invention relates to a sliding support for shower head.

It is known that it is rather common to connect shower heads to a support which is slidable along a vertical guide fixed to the wall in order to allow to place the shower head at the level best appreciated by the user.

Once the support has reached the chosen position, it must of course remain firmly in that position; for this purpose, conventional supports have locking means which are controlled by knobs or buttons which the user must first release every time he wishes to position the shower head differently and must then operate so as to achieve a locking action.

SUMMARY OF THE INVENTION

This is obviously awkward, and accordingly an aim of the present invention is to provide a sliding support which can be moved with the greatest comfort and remains firmly in the chosen position without having to perform particular maneuvers.

This aim is achieved by a sliding support for shower head, according to the present invention, characterized in that it comprises a slider associated with a guide which is fixed to a wall and has, at least at one end, tabs provided with means adapted to clamp said tabs in contact with said guide, an end element being associated with said slider and being provided with means for coupling a shower head.

Advantageously, the support according to the present invention is characterized in that the tabs protrude monolithically from the slider and are provided with raised portions for accommodating at least one elastic ring which is adapted to clamp said tabs in contact with the guide.

BRIEF DESCRIPTION OF THE DRAWINGS

Further characteristics and advantages of the present invention will become apparent from the following detailed description of a support, illustrated only by way of non-limitative example in the accompanying drawings, wherein.

DESCRIPTION OF THE PREFERRED EMBODIMENTS

Figure 1:
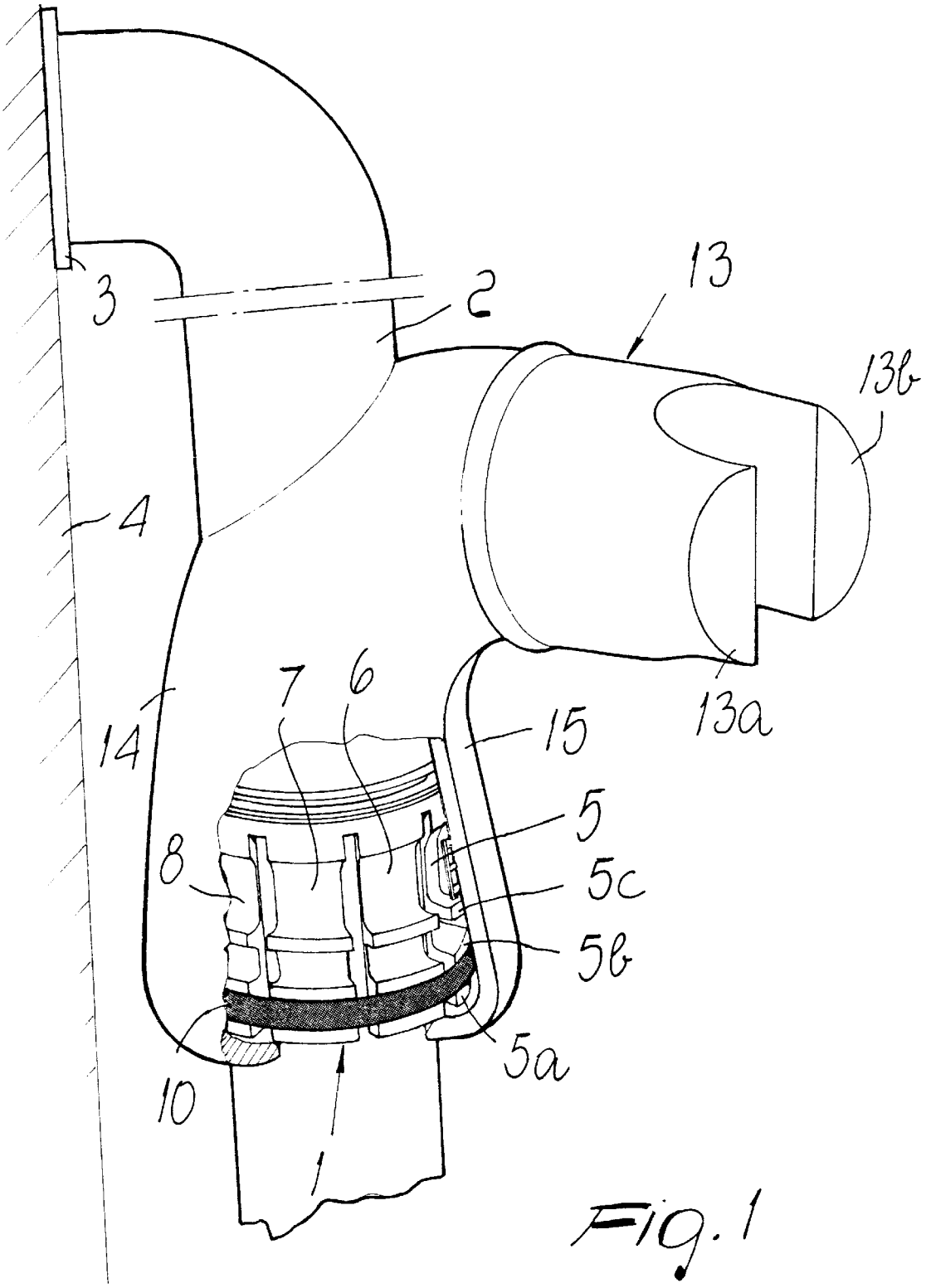
FIG. 1 is a perspective view of the sliding support for shower head according to the present invention, with a part of the wall removed for the sake of clarity in illustration.
Figure 2:
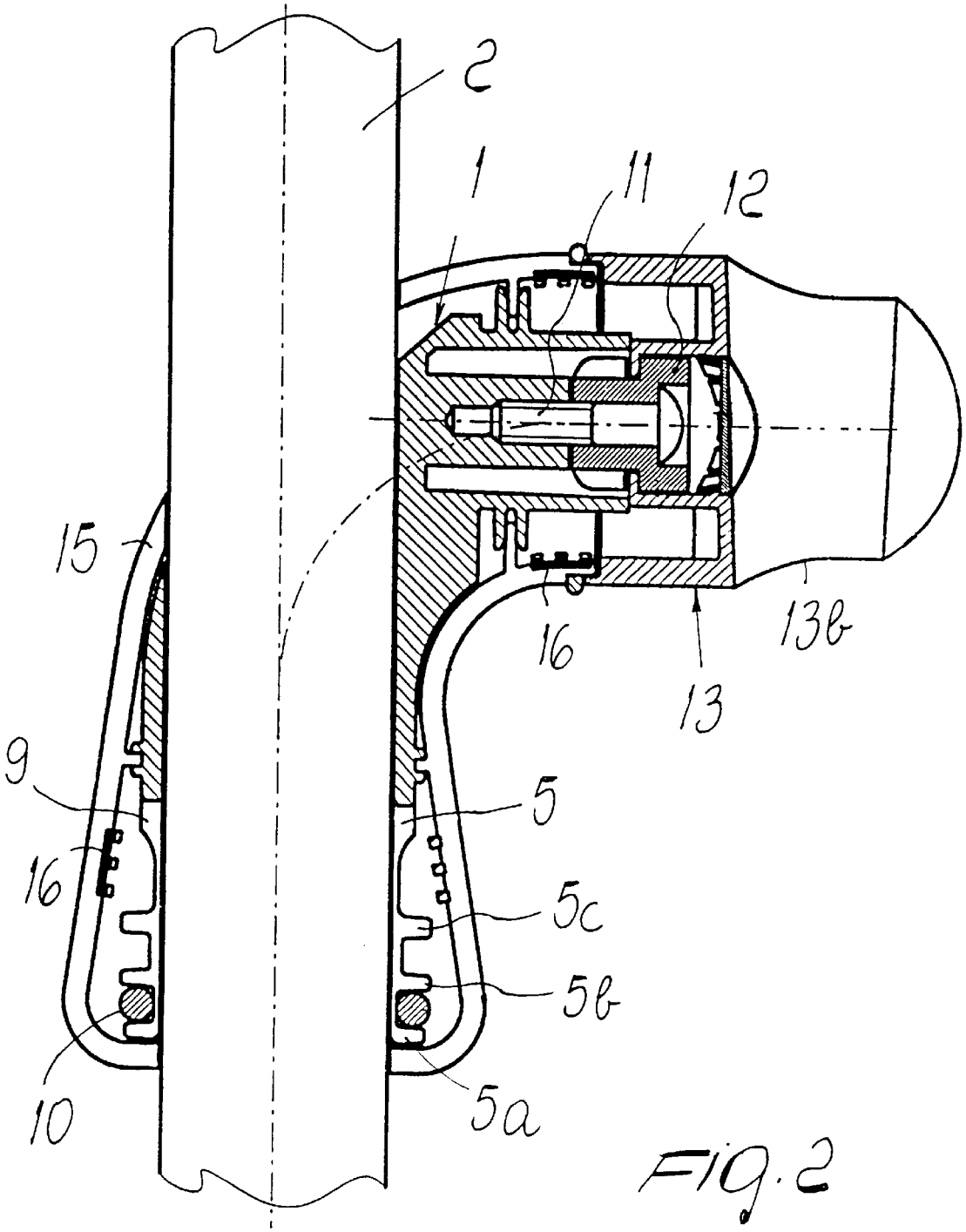
FIG. 2 is a longitudinal sectional view of the sliding support for shower head according to the present invention.

With reference to the above figures, the reference numeral 1 generally designates a slider, which is slidingly associated with a guide 2, having, at its end, a plate 3 for fixing to a wall 4.

The primary feature of the present invention resides in the fact that the slider 1 has, at one end, a plurality of tabs 5, 6, 7, 8 and 9 which protrude monolithically and have sufficient elasticity to be clamped in contact with the guide 2 by the action of an elastic ring 10.

The elastic ring 10 is accommodated in a band of those tabs which is delimited by raised portions 5*a*, 5*b* for the tab 5; however, the tabs are provided with a further set of raised portions, 5*c* for tab 5, which delimit a second band for optionally accommodating a second elastic ring or for accommodating the elastic ring 10 therein instead of in the first band.

The friction occurring between the tabs 5, 6, 7, 8 and 9 of the slider 1 and the guide can thus be chosen in the most appropriate manner to provide the optimum compromise between the need to prevent sliding of the slider 1 under the weight of a shower head which will be coupled thereto and the need to allow slider 1 to slide when simply pushed by a user who is seeking the most adapted vertical position of the shower head.

The slider 1 has, at its upper end, an end element 13, which is associated by means of a screw 11 with the interposition of a bush 12 and is provided with shower coupling means constituted by protrusions 13*a* and 13*b*.

Two half-shells 14 and 15 are also provided which are associated with the slider 1 and are locked to each other by means of a locking portion 16, which is adapted to cover slider 1 and blend it with the end element 13, so as to provide the user with good grip conditions and give the support a particular pleasant aspect.

The present invention thus provides for a support offering maximum functional convenience, since the user does not have to perform any maneuver other than a simple push to make the support assume the chosen position; in this position, it is the friction produced between the tabs of the slider, clamped against the guide, and the guide itself which automatically produces the locking action.

In the practical execution of the invention, all the details may be replaced with other technically equivalent elements; the materials employed, as well as the shapes and the dimensions, may also be any according to requirements.

What is claimed is:

1. A sliding support for a shower head, the sliding support comprising:

a longitudinal guide for being fixed to a wall;

a slider slidably connected with said guide;

an end element connected with said slider and having a coupling element for coupling a shower head to the sliding support;

a plurality of tabs of said slider arranged circumferentially around said longitudinal guide, said plurality of tabs being mutually spaced apart by gaps extending substantially parallel to a longitudinal extension of said longitudinal guide such that said plurality of tabs each extend also substantially parallel to the longitudinal extension of said longitudinal guide;

an elastic ring circumferentially positioned about said plurality of tabs such that said elastic ring forces said plurality of tabs in elastic contact with said longitudinal guide in a manner to sufficiently hold the sliding support in a selectably fixed position on said longitudinal guide and such that for selectively positioning the sliding support in the selectably fixed position on said longitudinal guide a user needs simply to grasp the sliding support and slidably move the sliding support on said longitudinal guide into the selectably fixed position without requiring that the user activate any lockable release mechanism.

2. A support according to claim 1, wherein said plurality of tabs extend monolithically from the slider and have raised portions for accommodating at least one said elastic ring.

3. A support according to claim 2, wherein said plurality of tabs have raised portions for accommodating two of said elastic rings.

4. A support according to claim 1, wherein the end element provided with said coupling element for coupling a shower head is detachably connected with the slider by means of a screw.

5. A support according to claim 1, further comprising two half-shells for being gripped by the user and connected with the slider so as to fully cover said slider and so as to blend with said end element provided with said coupling element for coupling a shower head to the sliding support.

6. A support according to claim 1 wherein said elastic ring is selectively positionable about said plurality of tabs in one of a plurality of selectable positions mutually spaced along a direction parallel to the longitudinal extension of said longitudinal guide for selecting an elastic locking force of said plurality of tabs on said longitudinal guide.

7. A support according to claim 1 wherein said plurality of tabs comprise circumferential protrusions which define a plurality of seats for holding said elastic ring in said plurality of selectable positions.

* * * * *